US012781444B2

(12) United States Patent
Springer

(10) Patent No.: US 12,781,444 B2
(45) Date of Patent: Nov. 3, 2026

(54) TAMPING UNIT FOR TAMPING A TRACK

(71) Applicant: Plasser & Theurer Export von Bahnbaumaschinen Gesellschaft m.b.H., Vienna (AT)

(72) Inventor: Heinz Springer, Tokyo (JP)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 400 days.

(21) Appl. No.: 18/682,533

(22) PCT Filed: Aug. 2, 2022

(86) PCT No.: PCT/EP2022/071666

§ 371 (c)(1),
(2) Date: Feb. 9, 2024

(87) PCT Pub. No.: WO2023/016858

PCT Pub. Date: Feb. 16, 2023

(65) Prior Publication Data

US 2025/0116073 A1 Apr. 10, 2025

(30) Foreign Application Priority Data

Aug. 9, 2021 (AT) ..... A50645/2021

(51) Int. Cl.
*E01B 27/20* (2006.01)

(52) U.S. Cl.
CPC ..... *E01B 27/20* (2013.01)

(58) Field of Classification Search
CPC ..... E01B 27/12; E01B 27/16; E01B 27/17; E01B 27/20; E01B 2203/12
See application file for complete search history.

(56) References Cited

U.S. PATENT DOCUMENTS

| | | | | |
|---|---|---|---|---|
| 4,092,903 | A * | 6/1978 | Allmer | E01B 27/16 |
| 4,096,806 | A * | 6/1978 | Allmer | E01B 27/16 |
| 11,179,750 | B2 | 11/2021 | Phillipp | |
| 11,821,147 | B2 * | 11/2023 | Kopf et al. | E01B 27/16 |
| 2006/0090666 | A1 | 5/2006 | Theurer et al. | |

FOREIGN PATENT DOCUMENTS

| | | | |
|---|---|---|---|
| AT | 517843 | A4 | 5/2017 |
| CN | 111501436 | A | 8/2020 |
| EP | 0331956 | A2 | 9/1989 |
| EP | 1653003 | A2 | 5/2006 |
| WO | 2018041391 | A1 | 3/2018 |

* cited by examiner

*Primary Examiner* — S. Joseph Morano
(74) *Attorney, Agent, or Firm* — Laurence A. Greenberg; Werner H. Stemer; Ralph E. Locher

(57) ABSTRACT

A tamping unit for tamping a track has tamping tools arranged in pairs. The tamping tools can be squeezed towards each other by a respective squeezing cylinder. A squeezing piston can be subjected to a hydraulic pressure of a first hydraulic circuit arranged in the respective squeezing cylinder. A vibration piston is assigned to each squeezing cylinder to superimpose a vibration on a squeezing movement. The vibration piston is arranged in a pressure amplifier with a primary cylinder and a secondary cylinder. In this way, vibration generation can be carried out at a lower pressure level.

12 Claims, 2 Drawing Sheets

TAMPING UNIT FOR TAMPING A TRACK

FIELD OF TECHNOLOGY

The invention relates to a tamping unit for tamping a track, with tamping tools arranged in pairs, which can be squeezed towards each other by means of a respective squeezing cylinder, with a squeezing piston that can be applied with a hydraulic pressure of a first hydraulic circuit being arranged in the respective squeezing cylinder, and with a vibration piston being assigned to each squeezing cylinder to superimpose a vibration on a squeezing movement.

PRIOR ART

A tamping unit with tamping tines being moved towards each other in pairs for tamping a track is known from EP 1 653 003 A1. This squeezing movement for ballast compaction is carried out with the aid of a squeezing cylinder that can be applied hydraulically. A vibration is hydraulically superimposed on the linear squeezing movement to achieve easier penetration of the ballast and improved compaction.

AT 517843 A4 discloses an improved hydraulic vibration generation. In this, a vibration piston for superimposing a squeezing movement with an adjustable vibration is arranged in every squeezing cylinder in addition to a squeezing piston. In this way, an optimization of the parameters required for the vibration generation is made possible, independent of the squeezing movement.

SUMMARY OF THE INVENTION

The object of the invention is to improve a tamping unit of the kind mentioned above in such a way that a hydraulic vibration with high energy efficiency is made possible.

According to the invention, this object is achieved by the features as claimed. Dependent claims indicate advantageous embodiments of the invention.

The respective vibration piston is arranged in a pressure amplifier (other names are pressure intensifier or pressure converter) with a primary cylinder and a secondary cylinder. In this way, vibration generation can be carried out at a lower pressure level. High pressures prevail only in the secondary cylinder of the pressure amplifier. In the primary cylinder, where the vibration is generated, lower pressures prevail, resulting in low energy losses during switching processes. The arrangement of the vibration-generating piston in a pressure amplifier separated from the squeezing cylinder improves controllability. For example, the vibration is only activated during a penetration process of the tamping tools into the ballast and during the squeezing process.

In a further development of the invention, the pressure amplifier is connected to a second hydraulic circuit via a control valve. For example, a hydraulic circuit already present in a tamping machine is used with a lower pressure level than in the first hydraulic circuit. This simplifies the set-up and maintenance of the entire hydraulic system.

Advantageously, the control valve is connected to a control device that is set up to actuate the control valve with variable vibration parameters. With this modified control variant, each phase of a tamping cycle can be linked to its own vibration parameters. For example, a vibration frequency of 40-50 Hz is predefined during a penetration process of the tamping tools into the ballast. The frequency is lowered to 35 Hz during squeezing, and the vibration stops when the tamping tools are raised. In addition to higher energy efficiency, this measure also results in lower noise emissions during operation. Additionally, the vibration amplitudes can be adjusted to the present properties of a ballast bed to be tamped. It can also be useful to predefine different vibration amplitudes for the penetration process and for the squeezing process.

In an improved variant, the control valve is designed as a proportional or servo valve, with a distance sensor being arranged to detect a piston travel and/or a piston position. In particular, this measures the position of the vibration piston in the secondary cylinder or primary cylinder of the pressure amplifier. The control valve is actuated via a control loop to regulate the vibration frequency and/or the vibration amplitude. A regulation dependent on the current position of the assigned squeezing piston can also be useful. In this way, a vibration frequency dependent on the squeezing distance can be predefined, for example, with the squeezing distance being measured by means of a further distance sensor or by means of an angle sensor arranged on a tilting arm. When using two hydraulic circuits, the amplitude and frequency of the vibration can be controlled particularly precisely and efficiently.

Further advantages result if the pressure amplifier, in particular the secondary cylinder of the pressure amplifier, is arranged directly on the assigned squeezing cylinder. In this way, the amount of hydraulic oil moved during a vibration cycle is reduced to a minimum. Accordingly, heat losses in the hydraulic circuit are low. Additionally, it is ensured that the vibration parameters remain stable during a squeezing process, as there are no flexible connecting hoses in the high-pressure section.

In an advantageous variant, each squeezing cylinder is assigned a first and a second pressure amplifier, with a first pressure chamber of the respective squeezing cylinder being connected with a pressure chamber of the assigned first pressure amplifier, and with a second pressure chamber of the respective squeezing cylinder being connected with a pressure chamber of the assigned second pressure amplifier. In this way, each squeezing cylinder is assigned its own vibration cycle. This means that each tamping tool can be applied with its own vibration. This is useful, for example, for turnout tamping units with tilting tines, so that tamping tines tilted up are not set into vibration.

In another advantageous variant, the two squeezing cylinders of a tamping tool pair are assigned two pressure amplifiers, with one pressure amplifier being connected with a first pressure chamber of the one squeezing cylinder, and with the other pressure amplifier being connected with a first pressure chamber of the other squeezing cylinder. This simplifies the set-up of the vibration-generating hydraulic system.

In this variant, the second pressure chambers of the two squeezing cylinders are usefully connected with a pressure accumulator. During a vibration cycle, energy is temporarily stored in this pressure accumulator, resulting in a high energy efficiency of the entire system.

In both variants, intermediate chambers of both pressure amplifiers are advantageously connected with a compensating accumulator or with a filling line applied with pressure. A corresponding preload pressure in the intermediate chambers ensures trouble-free functioning of the pressure amplifiers.

A further increase in energy efficiency is achieved by the fact that outlet openings between the squeezing cylinders and the pressure amplifiers are larger than connection openings of the squeezing cylinders to the first hydraulic circuit. This prevents a feedback effect on the first hydraulic circuit when the vibration is active. To generate vibrations, only hydraulic oil is pumped back and forth between the pressure amplifiers and the assigned pressure chambers of the squeezing cylinders.

BRIEF DESCRIPTION OF THE DRAWING

In the following, the invention is explained by way of example with reference to the accompanying figures. The following figures show in schematic illustrations.

DETAILED DESCRIPTION OF THE INVENTION

Figure 1:
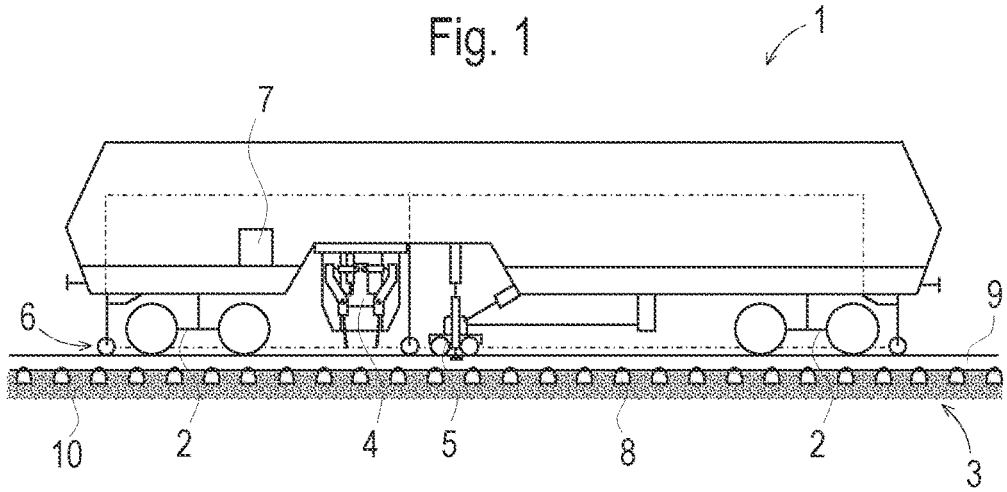
FIG. 1 Tamping machine on a track

The tamping machine 1 shown in FIG. 1 is movable on a track 3 to be tamped by means of rail running gears 2 and comprises a tamping unit 4, a lifting and lining unit 5, a measuring system 6, and a control device 7. The track 3 is a ballasted track in which a track panel formed of sleepers 8 and rails 9 is supported in a ballast bed 10. During a tamping process, the track panel is lifted into a target position by means of the lifting and lining unit 5 and, if necessary, shifted sideways. A comparison of the current position of the track panel with the target position is carried out by means of the measuring system 6.

The target position is fixed by the tamping unit 4 penetrating the ballast bed 10 between the sleepers 8 with vibrating tamping tines 11 and compacting ballast under the sleepers 8 with a squeezing process. A tamping tool 12 usually comprises two tamping tines 11 fastened next to each other in tamping tine mountings of a pivoting lever 13. The tilting arms 13 of tamping tools 12 opposite one another are tong-shaped and mounted on a shared tamping tool carrier 14. The tamping tool carrier 14 is guided height-adjustably in a tamping unit frame 15. Upper ends of the tamping tools 12 are linked to the tamping tool carrier 14 via respective squeezing cylinders 16.

Each squeezing cylinder 16 is designed as a hydraulic cylinder in which a squeezing piston 17 is coupled with the assigned tamping tool 12 via a piston rod 18. A first pressure chamber (piston chamber) 19 and a second pressure chamber (annular chamber) 20 can be applied with a respective hydraulic pressure of a first hydraulic circuit 23 via a first connection opening 21 and a second connection opening 22. The hydraulic pressure in the first pressure chamber 19 is increased via switching valves not shown to cause a squeezing movement 24 of the tamping tines 11. Thus, during a squeezing process, a squeezing pressure provided in the first hydraulic circuit 23 is present in the respective first pressure chamber 19.

A pressure difference between the first and second pressure chamber 19, 20 and the ratio of a piston area 25 adjacent to the first pressure chamber 19 to an annular area 26 adjacent to the second pressure chamber 20 thereby determines a desired squeezing force. To return the tamping tools 12, the second pressure chamber 20 is applied with an opening pressure in relation to the first pressure chamber 19, taking into account the area ratio. During a penetration process of the tamping tools 12 into the ballast bed 10, the two pressure chambers 19 are closed against the first hydraulic circuit 23. This is done via switching valves not shown, which are connected with the two connection openings 21, 22 via lines.

Figure 2:
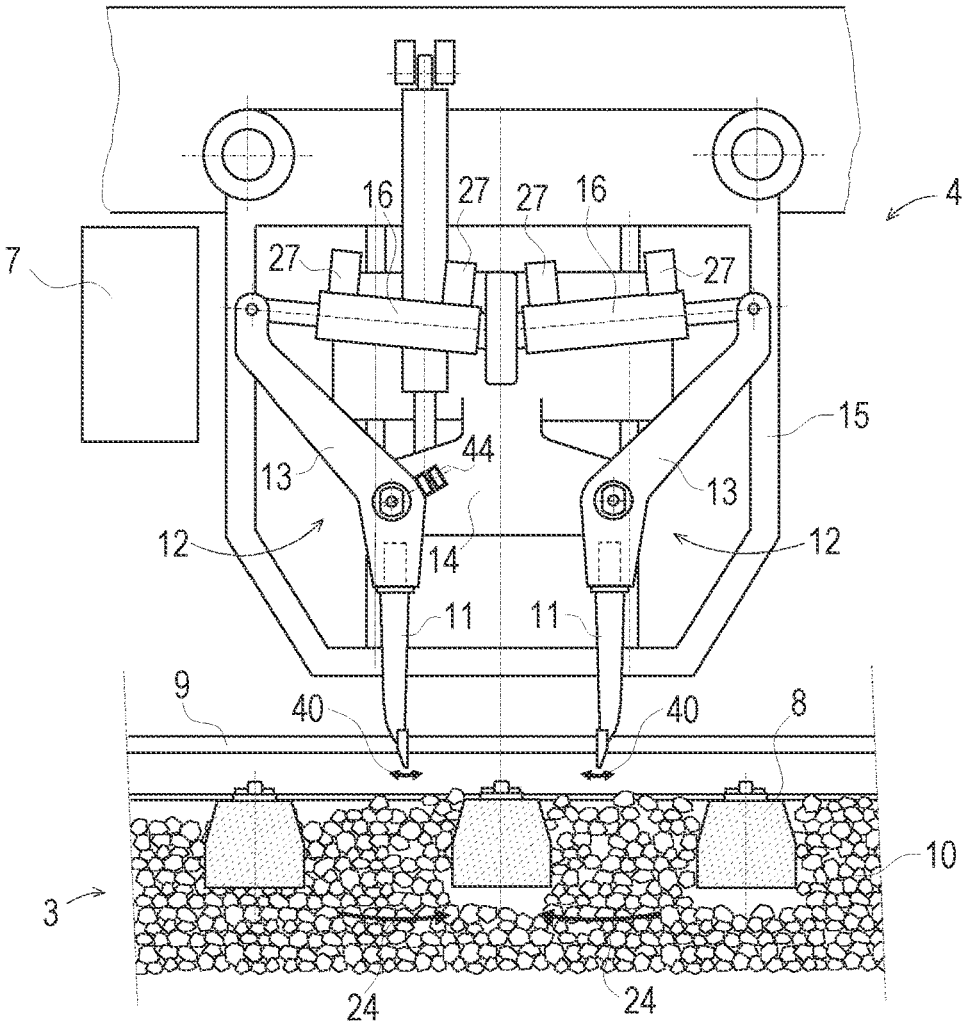
FIG. 2 Tamping unit
Figure 3:
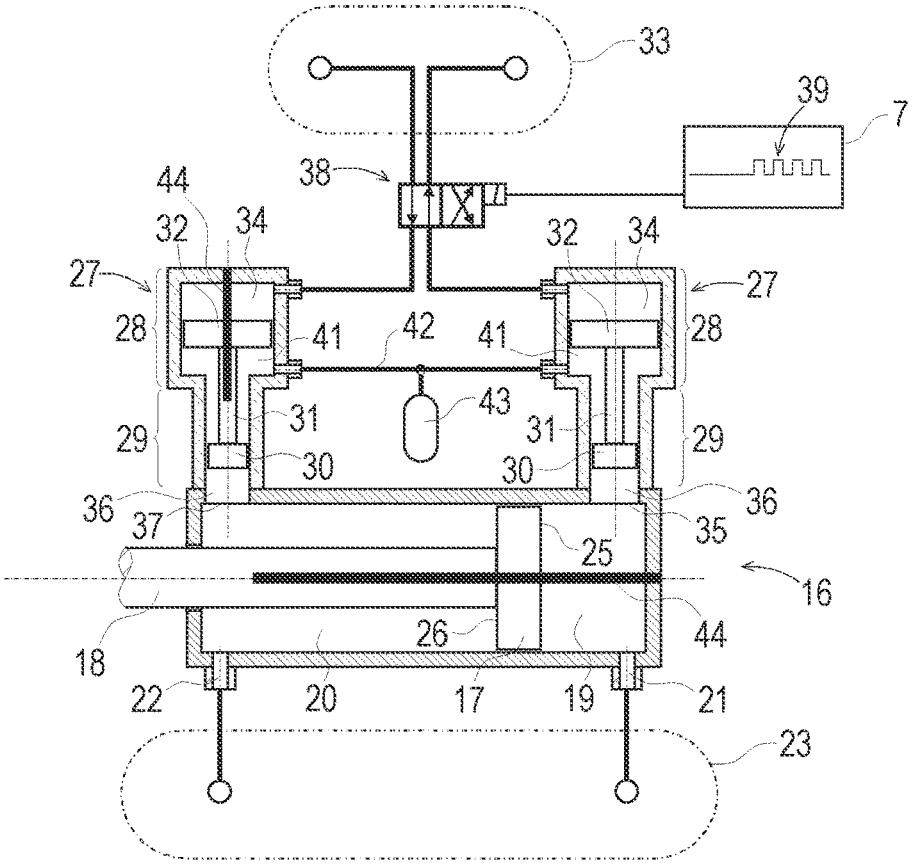
FIG. 3 Variant with two pressure amplifiers on one squeezing cylinder

According to the invention, each squeezing cylinder 16 is assigned at least one pressure amplifier 27. In the variant according to FIG. 2 and FIG. 3, each squeezing cylinder 16 is assigned two pressure amplifiers 27. Each pressure amplifier 27 comprises a primary cylinder 28 and a secondary cylinder 29. A vibration piston 30 is arranged in the respective pressure amplifier 27. For further clarification, the piston (secondary piston) in the secondary cylinder 28 is defined as a vibration piston 30. However, due to the rigid coupling by means of a connecting rod 31, the piston (primary piston) 32 in the primary cylinder 28 can also be regarded as a vibration piston.

The larger diameter of the primary piston 32 in relation to the diameter of the secondary piston 30 determines a pressure ratio of the pressure amplifier 27. In the present case, a low system pressure of a second hydraulic circuit 33 is translated to the hydraulic pressure prevailing in the first and second pressure chamber 19, 20 respectively via the respective pressure amplifier 27. The second hydraulic circuit 33 can be supplied from the first hydraulic circuit 23 by means of corresponding pressure regulators. Preferably, an existing hydraulic circuit with a correspondingly low pressure level is used.

When dimensioning the pressure amplifier 27, the ratio between the large piston area 25 and the annular area 26 of the assigned squeezing piston 17 must be taken into account. In particular, the diameters of the secondary pistons 30 are predefined by the volume changes occurring in the pressure chambers 19, 20 of the assigned squeezing cylinder 16 during active vibration. The primary pistons 32 of the pressure amplifiers 27 must be dimensioned in such a way that the same pressure always occurs in adjacent primary pressure chambers 34, namely the system pressure of the second hydraulic circuit 33. In this way, the same force acts on each primary piston 32 during pressurization. The length of the respective primary and secondary cylinder 28, 29 results from the maximum piston travel for generating the desired vibration.

The first pressure chamber 19 of the assigned squeezing cylinder 16 is connected with a secondary pressure chamber 36 of the first pressure amplifier 27 via a first outlet opening 35. The second pressure chamber 20 of the assigned squeezing cylinder 16 is connected with the secondary pressure chamber 36 of the second pressure amplifier 27 via a second outlet opening 37. The primary pressure chambers 34 are connected to the second hydraulic circuit 33 via a switching valve 38.

In the simplest case, the switching valve 38 is a 4/2-way valve that switches both pressure amplifiers 27 alternately to the system pressure of the second hydraulic circuit 33. For this purpose, the switching valve 38 is actuated by means of the control device 7, with a square-wave signal 39 determining the switching times. In this way, the squeezing piston 17 in the squeezing cylinder 16 is applied with a vibration, resulting in a vibrational movement 40 of the tamping tines 11. A frequency and an amplitude of the vibration is adjustable via the system pressure of the second hydraulic circuit 33 and the square-wave signal 39.

The outlet openings 35, 37 between the secondary cylinders 29 of the pressure amplifiers 27 and the pressure chambers 19, 20 of the assigned squeezing cylinder 17 are significantly larger dimensioned than the connection openings 21, 22 at the first hydraulic pressure circuit 23. During a penetration process, an oil inflow or oil outflow through the connection openings 21, 22 is closed by means of switching valves not drawn. In this, the hydraulic oil is pushed back and forth between the respective pressure chambers 19, 20 of the squeezing cylinder 16 and the assigned secondary pressure chamber 35 of the respective pressure amplifier 27 due to the corresponding dimensioning of the pressure amplifiers. As a result, the squeezing piston 17 vibrates in the squeezing cylinder 16. This vibration is transmitted to the assigned tamping tool 12 via the piston rod 18.

During a squeezing process, the vibration is maintained because the large outlet openings 35, 37 between the squeezing cylinder 16 and the pressure amplifiers 27 fill the secondary pressure chambers 36 before reaching a reaction time of overpressure relief valves installed. Equally, directly mounting the pressure amplifiers 27 on the assigned squeezing cylinder 16 ensures that the vibration is maintained by avoiding damping effects.

At the beginning of a working operation, the first pressure chamber (piston chamber) 19 is filled and then closed. The pressure amplifiers 27 are filled with the hydraulic pressure in the closed first chamber 19 and a counterpressure on the smaller annular area 26. After that, the switching valve 38 can begin to operate at any time.

Intermediate chambers 41 of both pressure amplifiers 27 are connected with each other via a compensating line 42. A compensating accumulator 43 is connected to the compensating line 42 so that the intermediate chambers 41 are applied with a preload pressure (e.g. 5 bar). When the vibration is activated, the slight volume fluctuations of the intermediate chambers 41 are compensated with this arrangement. Alternatively, a filling line with the same preload pressure level can be used.

In a further development of the invention, the switching valve 38 is designed as a servo valve or proportional valve. By means of a distance sensor 44, at least one piston travel within a cylinder 16, 28, 29 is detected. This can be done through direct measurement within the corresponding cylinder 16, 28, 29 or indirectly via the position of the tamping tools 12. A measuring signal corresponding to the piston travel is fed to the control device 7. Subsequently, the vibration is regulated by means of the control device 7 as a function of the measuring signal. This results in a control loop for a desired vibration amplitude.

Figure 4:
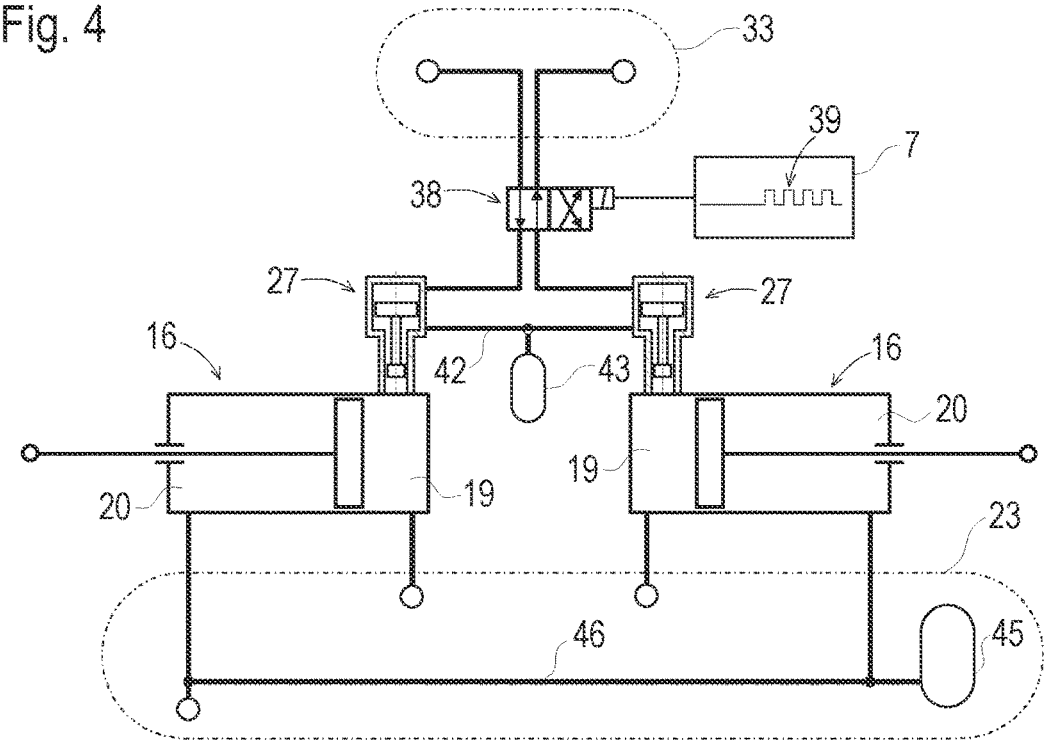
FIG. 4 Variant with two pressure amplifiers on a squeezing cylinder pair

A simplified design is shown in FIG. 4. Here, each squeezing cylinder 16 of tamping tools 12 opposite one another is assigned only one pressure amplifier 27. Specifically, each first pressure chamber (piston chamber) 19 is connected with the secondary pressure chamber 36 of the assigned pressure amplifier 27. Application of the system pressure of the second pressure circuit 33 to the primary pressure chambers 34 is carried out according to the example in FIG. 3. A compensating line 42 with a compensating accumulator 43 or a filling line is also present. Additionally, there is a pressure accumulator (hydraulic accumulator) 45, which is connected to a connecting line 46 of the second pressure chambers (annular chambers) 20.

During a penetration process, the pressure in this connecting line 46 and in the second pressure chambers 20 is isolated from the rest of the hydraulic circuit by means of valves not shown. The pressure peaks that occur during the active vibration are temporarily stored by means of the pressure accumulator 45. In the process, hydraulic oil is stored in the pressure accumulator 45 when the edge of the square-wave signal 39 rises and is released again when the edge falls.

When a squeezing process begins, the closure of the connecting line 46 and the second pressure chambers 20 is released, and hydraulic oil can flow back into the first hydraulic circuit 23. The vibration is maintained, with hydraulic oil continuing to be stored in the pressure accumulator 45 with each rising edge of the square-wave signal 39 and released again when the edge falls. In this way, heating of the hydraulic oil due to the applied vibration is avoided.

The invention claimed is:

1. A tamping unit for tamping a track, the tamping unit comprising:

tamping tools arranged in pairs, and disposed to be squeezed towards one another by way of respective squeezing cylinders;

each said squeezing cylinder having a squeezing piston to be subjected to a hydraulic pressure of a first hydraulic circuit;

each said squeezing cylinder having a respective vibration piston assigned thereto for superimposing a vibration on a squeezing movement;

said vibration piston being arranged in a pressure amplifier with a primary cylinder and a secondary cylinder.

2. The tamping unit according to claim 1, wherein said pressure amplifier is connected to a second hydraulic circuit via a control valve.

3. The tamping unit according to claim 2, wherein said control valve is connected to a control device configured to actuate said control valve with variable vibration parameters.

4. The tamping unit according to claim 2, wherein said control valve is a proportional valve or servo valve, and wherein a distance sensor is arranged to detect at least one of a piston travel or a piston position.

5. The tamping unit according to claim 1, wherein said pressure amplifier is arranged directly on the respectively assigned said squeezing cylinder.

6. The tamping unit according to claim 1, wherein said secondary cylinder of said pressure amplifier is arranged directly on the respectively assigned said squeezing cylinder.

7. The tamping unit according to claim 1, wherein each said squeezing cylinder is assigned a first said pressure amplifier and a second said pressure amplifier, a first pressure chamber of the respective said squeezing cylinder is connected with a pressure chamber of the respectively assigned said first pressure amplifier, and a second pressure chamber of the respective said squeezing cylinder is connected with a pressure chamber of the respectively assigned said second pressure amplifier.

8. The tamping unit according to claim 7, wherein said two pressure amplifiers have intermediate chambers connected via a compensating accumulator or via a filling line applied with pressure.

9. The tamping unit according to claim 1, wherein said two squeezing cylinders of a pair of tamping tools are assigned two said pressure amplifiers, with one pressure amplifier being connected with a first pressure chamber of one of said two squeezing cylinders, and another pressure amplifier of said two said pressure amplifiers being connected with a first pressure chamber of another of said two squeezing cylinders.

10. The tamping unit according to claim 9, wherein second pressure chambers of said two squeezing cylinders are connected with a pressure accumulator.

11. The tamping unit according to claim 9, wherein said two pressure amplifiers have intermediate chambers connected via a compensating accumulator or via a filling line applied with pressure.

12. The tamping unit according to claim 1, wherein outlet openings formed between said squeezing cylinders and said pressure amplifiers are larger than connection openings of said squeezing cylinders to said first hydraulic circuit.

* * * * *